United States Patent [19]

Sperry et al.

[11] 4,118,925

[45] Oct. 10, 1978

[54] COMBUSTION CHAMBER AND THERMAL VAPOR STREAM PRODUCING APPARATUS AND METHOD

[75] Inventors: John S. Sperry, Houston; Richard W. Krajicek, Sugar Land; Robert R. Cradeur, Spring, all of Tex.

[73] Assignee: Carmel Energy, Inc., Houston, Tex.

[21] Appl. No.: 771,558

[22] Filed: Feb. 24, 1977

[51] Int. Cl.[2] ..... F02G 3/00

[52] U.S. Cl. ..... 60/39.05; 60/39.57

[58] Field of Search ..... 60/39.05, 39.55, 39.56, 60/39.57, 39.65, 39.69; 126/360 R, 360 A, 366, 367, 368

[56] References Cited

U.S. PATENT DOCUMENTS

| | | | |
|---|---|---|---|
| 1,047,152 | 12/1912 | Benedict | 60/39.57 |
| 1,755,846 | 4/1930 | Steed | 60/39.65 |
| 2,476,185 | 7/1949 | Goddard | 60/39.55 |
| 3,276,205 | 10/1966 | Reisman et al. | 60/39.55 |
| 3,918,255 | 11/1975 | Holden | 60/39.65 |
| 3,939,653 | 2/1976 | Schirmer | 60/39.65 |

FOREIGN PATENT DOCUMENTS 105,472 2/1971 Mexico.

*Primary Examiner*—Louis J. Casaregola
*Attorney, Agent, or Firm*—Pravel, Wilson & Gambrell

[57] ABSTRACT

A new and improved method and apparatus for burning a hydrocarbon fuel for producing a high pressure thermal vapor stream comprising steam and combustion gases for injecting into a subterranean formation for the recovery of liquefiable minerals therefrom, wherein a high pressure combustion chamber having multiple refractory lined combustion zones of varying diameters is provided for burning a hydrocarbon fuel and pressurized air in predetermined ratios injected into the chamber for producing hot combustion gases essentially free of oxidizing components and solid carbonaceous particles. The combustion zones are formed by zones of increasing diameters up a final zone of decreasing diameter to provide expansion zones which cause turbulence through controlled thorough mixing of the air and fuel to facilitate complete combustion. The high pressure air and fuel is injected into the first of the multiple zones where ignition occurs with a portion of the air injected at or near the point of ignition to further provide turbulence and more complete combustion.

22 Claims, 4 Drawing Figures

FIG. 3
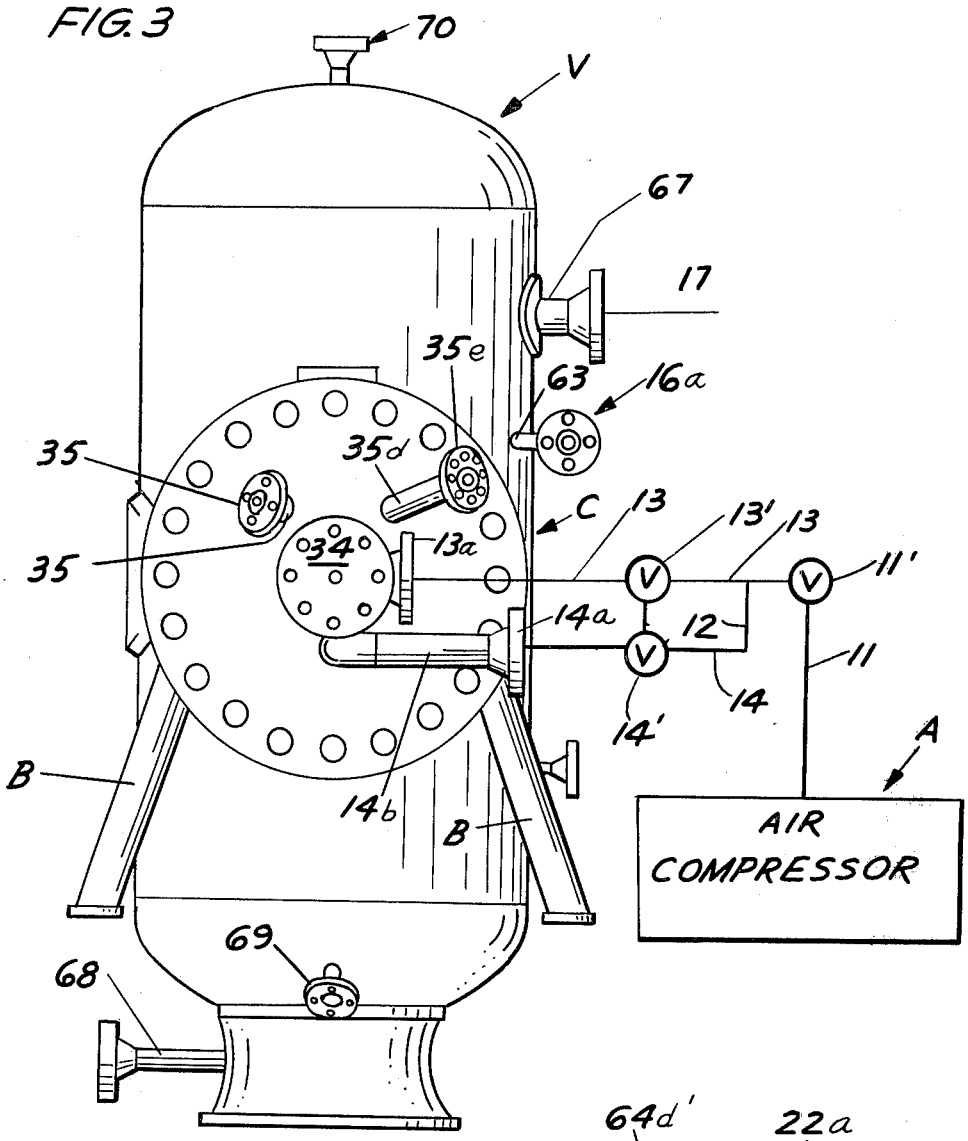
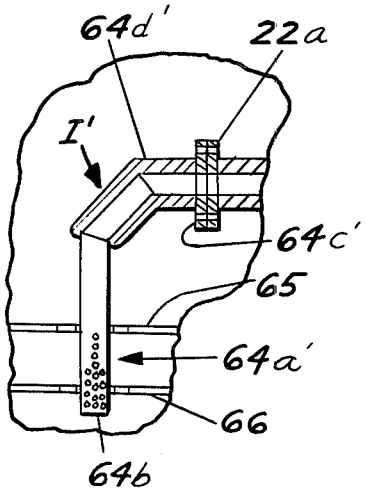
FIG. 4

COMBUSTION CHAMBER AND THERMAL VAPOR STREAM PRODUCING APPARATUS AND METHOD

The government of the United States of American has rights in this invention pursuant to Contract No. EY-76-C-02-2880 awarded by the U.S. Energy Research and Development Administration.

BACKGROUND OF THE INVENTION

This invention relates to fluid pressure generators and more particularly pertains to an apparatus and method for producing a high pressure thermal vapor stream comprised of steam and combustion gases, carbon dioxide, nitrogen, water, sulfur dioxide, and other combustion products, for injection into a subterranean formation, particularly a petroleum-bearing formation, for the recovery of liquefiable minerals therefrom.

Apparatus for producing a pressurized thermal fluid stream comprised of mixtures of steam and combustion gases and for injecting such streams into a subsurface formation for recovering liquefiable minerals, e.g., sulfur, mercury, gilsonite, heavy viscous petroleum and the like have heretofore been disclosed in the prior art. Examples of some such apparatus are described in the following patents, to name a few: U.S. Pat. Nos. 3,620,571; 2,916,877; 2,839,141; 2,793,497; 2,823,752; 2,734,578; 2,754,098 and Mexican Pat. No. 105,472.

So far as known, the prior art thermal vapor producing apparatus have not been satisfactory for producing sufficient quantities of high pressure thermal vapors of steam and combustion gases for sufficient time periods for injection into a subsurface formation for economical recovery of highly viscous petroleum therefrom. Some of the high pressure combustion chambers of these apparatus are incapable of complete combustion of hydrocarbon fuels in the presence of the stream of high pressure air injected therein. This results in the formation of a partially combusted gas stream which contains harmful oxidizing components such as nitrous oxides, carbon monoxide, etc., as well as solid carbonaceous particles, i.e. soot. As known, these gases may be extremely harmful in that they may cause undesirable reactions with the liquefiable minerals being recovered, particularly viscous petroleum. Additionally, the soot may collect in the pressurized combustion chamber and steam generating vessel thereby causing frequent mechanical breakdowns. The soot may also be carried over to plug the well and formation. Furthermore, as far as known, most prior art apparatuses having sufficient size cannot be operated continuously for extended lengths of time, as usually required in economical injection techniques for recovery of the petroleum, without suffering mechanical breakdown due to overheating and burning out of the pressurized combustion chamber.

It is well-known that in order to provide economical recovery of liquefiable minerals large volumes of a thermal fluid must be generated and injected into the formation. This is particularly true in techniques for the recovery of viscous petroleum wherein the thermal fluid is usually continuously produced and injected into a petroleum-bearing formation over a period of from several hours to several days and even months. Additionally, in such techniques for the recovery of petroleum, the thermal fluid must be injected into the subterranean formation under pressures higher than the formation pressure. However, so far as is known, no one previously has provided a satisfactory apparatus for producing and injecting a high pressure thermal vapor stream comprised of steam and combustion gases in sufficiently high volumes and under sufficiently high pressure to provide satisfactory economic recovery of the viscous petroleum. Since there are large quantities of hithertofore unproducible crude petroleum, this invention becomes very important in times when all available fossil fuels are needed.

SUMMARY OF THE INVENTION

This invention relates to a new and improved high pressure multiple zone combustion chamber having specifically positioned injector means for injecting first and second streams of pressurized air along with a fuel into the first zone of the chamber's combustion zones to facilitate substantially complete combustion of a hydrocarbon fuel under high pressures, for example within the range of from about 300 to about 1,000 psig, for producing a high volume stream of hot combustion gases and inert gases, such as nitrogen, under such high pressure which is essentially free of solid carbonaceous particles. The chamber preferably includes three refractory lined zones having increasing diameters so as to provide turbulence through controlled expansion and intimate mixing of the air and fuel upon expansion. A final refractory lined zone has the smallest diameter which further increases the turbulence and velocity of the combustion gases exiting the combustion chamber into a steam generating vessel. Refractory lined transition zone portions connect the multiple zones and an outer water jacket prevent overheating from hot spots to allow operation over the extended periods of time required to produce the thermal vapor stream comprising steam, the hot combustion gases, and hot inerts for injection into a subterranean formation for economical recovery of viscous petroleum or other liquefiable minerals therefrom. A steam generating vessel holds a water supply and is mounted with the new and improved combustion chamber for receiving the hot combustion gases for producing high volumes of a thermal mixture comprised of steam and essentially completely combusted combustion gases free of harmful oxidation products and soot at high pressures.

BRIEF DESCRIPTION OF THE DRAWINGS

The instant invention will be better understood by reference to the drawings which illustrate specific embodiments.

FIG. 3 is an end view of the apparatus taken along line 3—3 in FIG. 2; and, FIG. 4 is a cross-sectional broken view showing a second embodiment of the injection means.

DETAILED DESCRIPTION OF THE PREFERRED EMBODIMENTS

Figure 1:
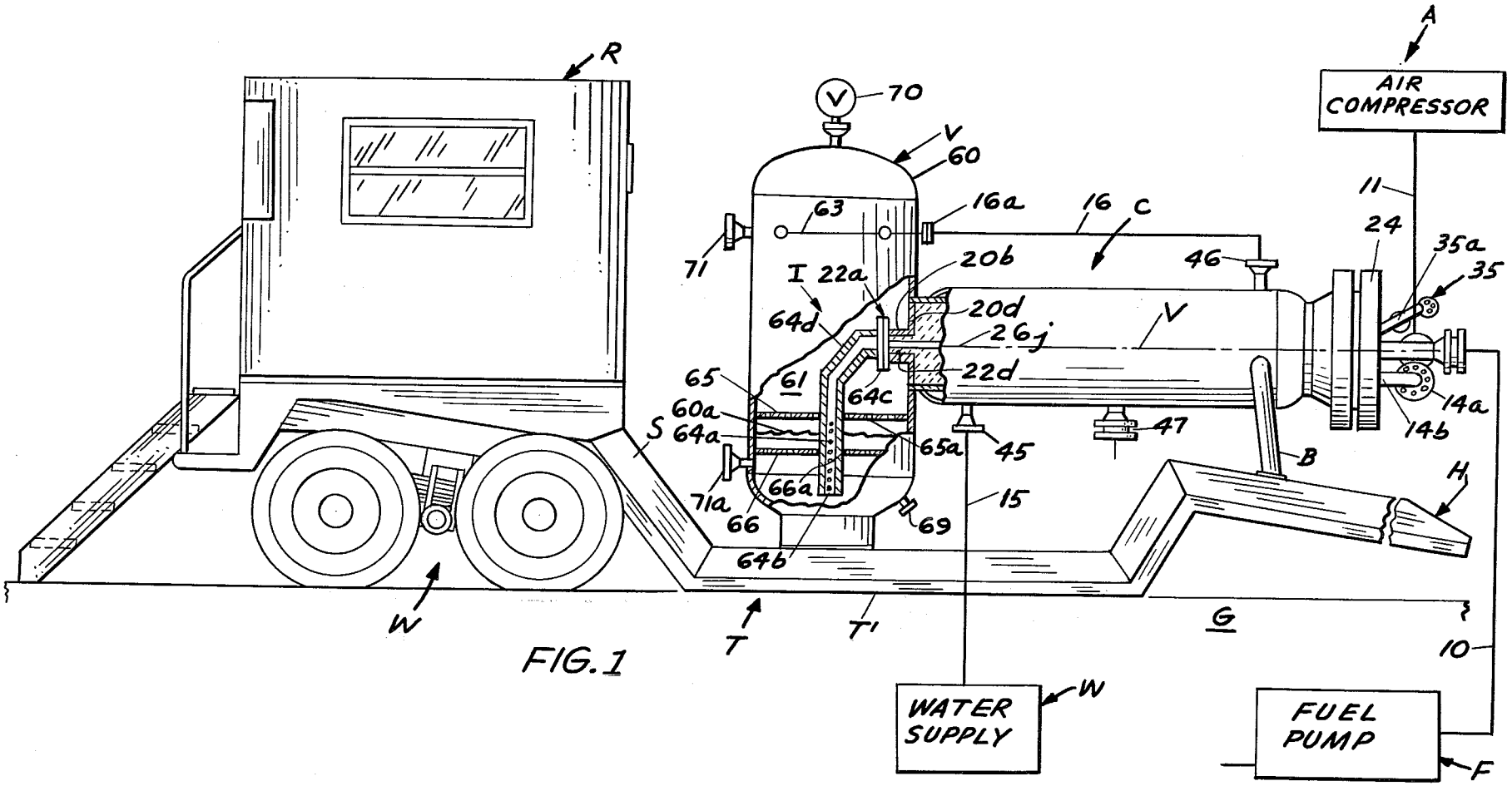
FIG. 1 is an elevational schematic view, partially in section, of the preferred embodiment of the apparatus of the invention showing it mounted for mobile transport between operating locations.

Referring now to the drawings, in FIG. 1 the letter C designates the new and improved high pressure combustion chamber of the present invention which is mounted upon a trailer T having transport wheels W and is connected to a fuel supply means F and a pressurized air supply means A. Mounted on the frame S is a control room R which houses the controls for the burner and vapor generator. The trailer T is adapted to be connected with a tractor or other prime mover through hitch H for transporting to the site of the well to be treated. The mobile trailer permits quick transport to another well after treatment is complete. It is understood that a sled or permanent installation could also be used. The loer portion T' of the trailer is designed to rest on the ground G to provide stability to the trailer during operation of the burner. Brace members B support the combustion chamber C on the frames. The fuel supply means F preferably includes a suitable fuel pump or compressor, depending upon the type of fuel employed, capable of supplying a continuous supply of fuel to the combustion chamber C through line 10 from a suitable fuel storage area (not shown) which in the practice of this invention can include fuel from the well being treated or adjacent wells in the field. Once operation begins, the apparatus of this invention can be operated on crude oil which had not only been heretofore difficult to extract from the ground, but which would have been considered unfit for use without processing.

The air supply means A includes at least one high capacity air compressor capable of supplying pressurized air at a volume of up to about 2 million SCFD under a pressure within the range of from about 300 to about 1,000 psig. The high pressure air stream is supplied from the air supply means A through line 11 and is split in a manifold 12 (schematically shown in FIG. 3) into a first, or primary, air stream and a second, or secondary, air stream which are supplied separately to the combustion chamber C via lines 13 and 14, respectively. As more particularly described hereafter, the high pressure combustion chamber C includes an improved second, or secondary, air stream injection means for facilitating substantially complete combustion of the hydrocarbon fuel to produce the continuous flowing stream of hot combustion gases substantially free of oxidizing components and solid carbonaceous particles. As used herein, the term "combustion gases" is construed to include the gases from combustion, i.e., carbon dioxide, water, sulfur dioxide, and the like, and also inert gases entering with air used for combustion.

The relative volumes of the primary and secondary air and fuel are determined in part by empirical means to provide optimum combustion. It is preferred to not provide excess air resulting in an oxidizing atmosphere in the output flow stream, but rather to approach a stoichiometric mixture or maintain a slightly reducing atmosphere in the output flow stream. The ratios of the volumes of the air streams and fuel are adjusted to provide a mixture which results in the desired output flow stream free of soot and substantially free of incomplete combustion products. As explained hereinafter, means is provided for sampling the flow stream which can be used to regulate the combustion chamber.

The apparatus also includes a preferred steam generating vessel V shown in FIG. 1 mounted on the trailer T and connected with the combustion chamber C which is adapted to receive the stream of hot combustion gases therefrom and a stream of water supplied thereto by a water supply means through line 15, a water jacket around the combustion chamber (described hereafter) and line 16 to inlet connection 16*a*. The water supply means W includes suitable pressure pumps or the like capable of supplying a continuous stream of water from a suitable storage or supply area (not shown) to the outer water jacket and to the steam generating vessel V. The steam generating vessel V is provided with an injecting means I communicating with the combustion chamber C for injecting the flowing stream of hot combustion gases into a water supply or bath in the steam generating vessel V for generating steam and controlling the temperature of the thermal vapor stream. The generated steam and hot combustion gases are mixed in the preferred steam generating vessel V thereby producing a high pressure thermal vapor stream which may be injected as desired via connection 17 (FIG. 3) into a suitable well penetrating a subsurface formation for the recovery of liquefiable minerals, particularly viscous petroleum, therefrom as more particularly described hereafter. Steam generators other than the preferred vessel V could also be used with the combustion chamber C of this invention.

Figure 2:
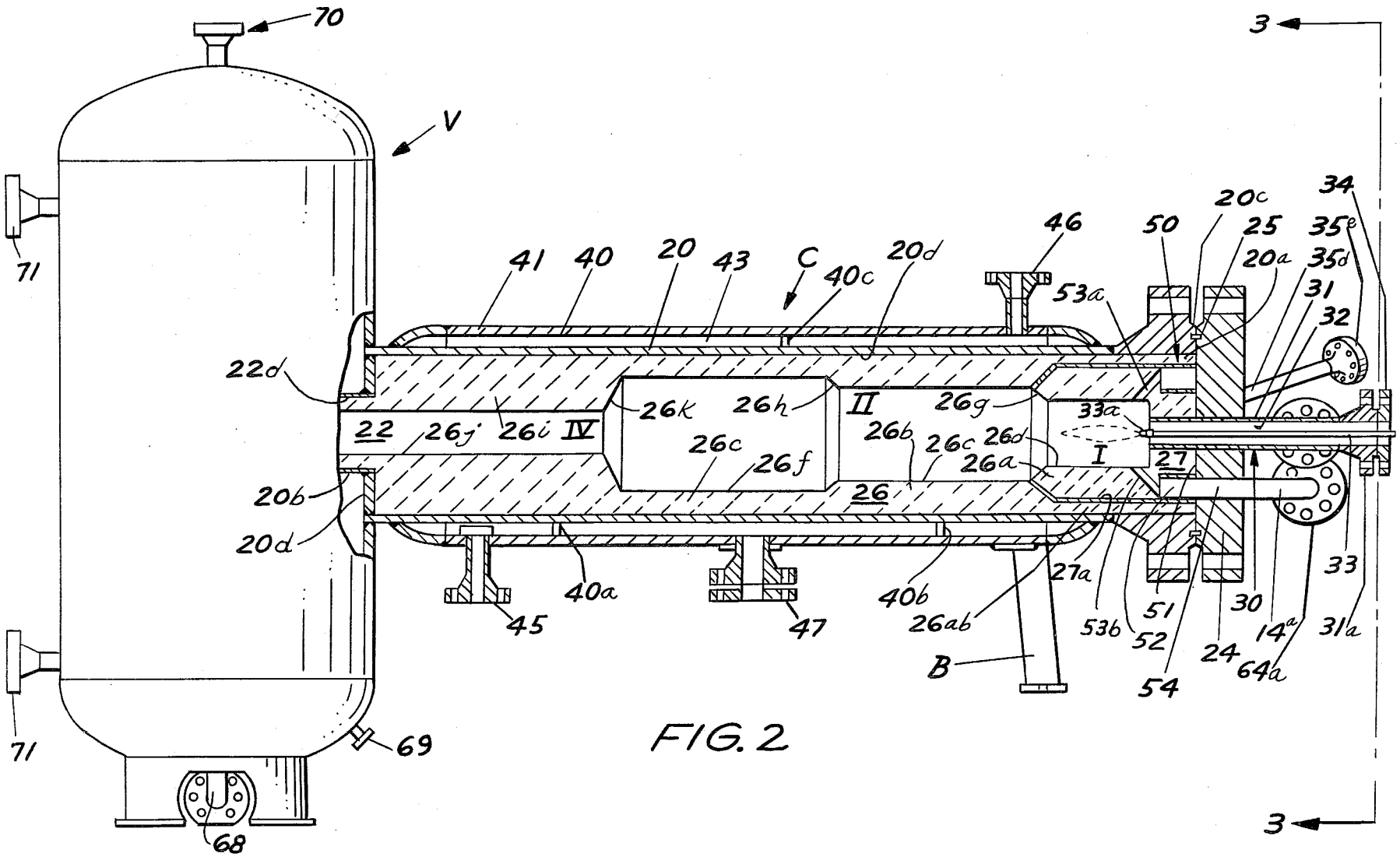
FIG. 2 is a cross-sectional view of the combustion chamber of the present invention illustrating the details thereof.

Referring now to FIG. 2 of the drawings, the new and improved high pressure combustion chamber C preferably includes a substantially cylindrical pressure casing 20 which may be 24 inch O.D. pipe having an inlet end 20*a* and an exhaust outlet 22 provided at its opposing end 20*b*. The exhaust outlet 22 has an outwardly extending annular flange 22*a* (FIG. 1) for sealing interconnection with a similar flange of a combustion gas injection means I provided with the preferred steam generating vessel V for passing the hot combustion gases produced by the combustion chamber C to the steam generating vessel V and for injecting the gases through a water bath or supply in the vessel described more particularly hereafter. Preferably, the pressure casing 20 is of cylindrical shape with its exhaust or outlet portion 20*b* also cylindrical. Additionally, the exhaust outlet 22 is preferably aligned with the longitudinal axis L of the pressure casing 20 and has a smaller cross-sectional diameter relative to the casing. Flange 20*d* is connected to the exhaust portion and casing with suitable means, such as welds securing them together.

A high pressure closure member 24 is mounted with the pressure casing open end 20*a* in high pressure sealing engagement therewith. More particularly, the pressure casing 20 has an outwardly extending connector flange 20*c* which is adapted to be connected with the closure member 24 in a suitable manner, such as by interconnecting bolts or the like (not shown). Preferably, a sealing means 25, such as a high pressure and high temperature seal of conventional construction, is positioned between the closure member 24 and the annular flange 20*c* to effect the high pressure sealing engagement therebetween.

The pressure casing and exhaust outlet inner surfaces 20*d* and 22*d*, respectively, are lined with a continuous inner liner of refractory material 26 which forms the combustion zones communicating with the combustion gas injection means I via the exhaust outlet 22. A similar cylindrical portion of refractory material 27 forms a portion of the liner 26 and is provided adjacent a portion of the closure member inner surface 24*a*. The continuous inner liner of refractory material 26 has portions of varying cross-sectional thicknesses to form sections of varying inner diameters for a reason as more fully explained hereinafter. As illustrated in FIG. 2, the refractory material liner includes a first cylindrical section 26*a* having a cylindrical wall with a first inner diameter extending longitudinally from the pressure casing open end 20*a* to a predetermined distance therefrom and secured with the inner surface of the cylindrical member 27a to form a first combustion zone I. The first zone I may have an inside diameter of about nine inches and a length of about fourteen inches. A cylindrical portion 26ab of the liner surrounds the casing 27a. Contiguous with the first section is a second cylindrical section 26b having a relatively smaller cross-sectional wall thickness extending from the portion 26a and hence a second larger inner diameter extending longitudinally from the first section a predetermined distance within the pressure casing 20 to form a second combustion zone II. The second combustion zone II may have an inside diameter of about thirteen and one-quarter inches and a length of about twenty-eight inches. A third section 26c contiguous with the second section has a cross-sectional wall thickness less than that of the second or intermediate wall section 26b providing an even larger inner diameter extending longitudinally therefrom lining the pressure casing to form a third combustion zone III. The third combustion zone III may have an inside diameter of about sixteen inches and a length of about thirty-one and one-quarter inches. The outlet portion of the casing and the exhaust outlet portion is also lined with cylindrical refractory material 26i which has the smallest inner diameter to form a fourth or final zone IV. The fourth zone IV may have an inside diameter of about six inches and a length of about forty and three-quarter inches. This provides considerable turbulence and intimate mixing to insure complete combustion. Each of these sections 26a, 26b, and 26c are concentric with the pressure chamber longitudinal axis L (FIG. 1). The inner surfaces 26d, 26e, and 26f of the sections 26a, 26b, and 26c, respectively, define three expansion combustion zones of the chamber. The refractory lined first zone I may have an inside diameter of about 63–78% of the inside diameter of the second zone II. Further, the refractory lined second zone II may have an inside diameter of about 78–93% of the inside diameter of the third zone III. The refractory lined fourth zone IV may have an inside diameter of about 32.5–47.5% of the inside diameter of the third zone III.

The inside diameter and the longitudinal length are related in that their values determine the volumes of each combustion zone which effects the controlled expansion providing the desired turbulence and mixing. However, the diameter value is more significant since it provides the rapid turbulence due to the radial expansion. The length of the zones can be varied from the preferred values with the limitation of maintaining optimum turbulence and mixing in each zone to provide substantially complete combustion. The length also effects the overall size and compactness of the apparatus which is preferably mounted for transport on the trailer T between numerous wells to be treated. The volumes of zones I, II, and III increase along the combustion chamber, but the increase in the volume between the second and third zones is primarily due to the increase in diameter. Altough the different diameter combustion zones are achieved by varying the thickness of the refractory material, this could also be achieved with an outer casing of varying sizes for casing 20, with a constant thickness for the refractory material. The result would still be varying sized combustion zones which would maintain turbulence to provide complete combustion.

The relative diameters of the zones of the combustion chamber are important to control expansion of the fuel-air mixture during combustion. It is believed that it is desirable to create maximum turbulence in the zones during combustion as the ignited fuel-air mixture flows through the chamber and out the exhaust end. Accordingly, as temperature increases, the increasing volumes of the zones I, II, and III allow expansion of the combustion gases which compensates some for the otherwise increases in velocity. The rapid radial expansion causes turbulence which thoroughly mixes the fuel and air for more complete combustion. A stoichiometric mixture of fuel and air is preferred so no excess air is available, but in the practice of this invention up to about 5% molar excess can be tolerated, preferably about 3% molar excess. Under such conditions, the substantially complete mixing provides substantially complete combustion of the fuel so that the combustion gases are substantially free of non-oxidizing gases. Overexpansion could so decrease velocity such that incomplete mixing could result from lack of sufficient turbulence. In operation, there may be a pressure drop in the chamber 26 from the first section to the exhaust of in the order of about 5 psig. The fourth zone IV has a lesser diameter which increases the velocity of the gases flowing from the third zone which also causes turbulence and mixing so that any unconsumed fuel may come in contact with any remaining oxygen to complete combustion.

As illustrated in FIG. 2, cylindrical beveled surfaces 26g and 26h define the inner surfaces of the refractory material lining 26 and form the transition zone portions of the first zone I and second zone II, respectively. The beveled surfaces 26g and 26h face downstream and are angled outwardly. Preferably, each beveled surface 26g and 26h is angled outwardly from about 30° to about 45° from the constant diameter portions of the first zone and the second zone. The gradual increase in diameters of the transition zones serves to prevent hot spots which could result in burning through the liner and casing 26. Without this gradual increase of the diameter of the transition zone portions, it has been found that a sharp corner may cause a swirl which concentrates the hot combustion gases at the corner transition point between zones, causing such to burnout and resulting in failure of the unit.

The final section 26i of the refractory lining is positioned at the exhaust outlet inner surface 22b and has an inner cylindrical surface 26j which has a diameter less than that of the first section 26a to form a fourth or final zone IV. The beveled surface 26k forms a transition zone portion of the third section to connect with the final section so as to gradually decrease the diameter of the third zone. The beveled surface 26k is oriented at in the order of about 60° to the direction of flow through the zones. It is believed that the final zone may act as a final combustion zone to combust any unburned fuel with any unconsumed air. The velocity and turbulence in the final section is greater than that of the third section because of its smaller size. The inner diameter of the final section remains the same as it extends into the vessel V but the outer diameter decreases through exhaust outlet 20b.

As illustrated, the above-described continuous refractory material layer 26 forms a combustion chamber 28 having an opposed modified staircase longitudinal cross-sectional shape. This construction prevents the formation of hot spots within the combustion zone 28 during the combustion of a hydrocarbon fuel therein and thus protects the pressure casing 20 from structural failure. This construction also provides controlled combustion to facilitate substantially complete combustion.

Any products of combustion will fall into the category of "pollutants" can be eliminated or removed by adding scrubbers to the burner. Such scrubbers are known in the art and have particularly utility with the present invention because fewer "pollutants" are produced making it possible to effectively use the scrubbers.

The refractory liner, varying sized combustion zones, shape of the zones including the transition zone portions, location of the fuel, primary air and secondary air inlets and other features make the apparatus and method of this invention capable of efficiently and substantially completely combusting the fuel to produce a large amount of high temperature and high pressure gases for an extended period of time without the production of soot as would be expected to be found. As far as known, any burner approaching the output and capabilities of the present invention has never been successfully operated.

The combustion chamber C is provided with an injection assembly 30 for injecting the hydrocarbon fuel supplied through line 10 (FIG. 1) and the first or primary pressurized air steam supplied through line 13 (FIG. 3) through three-way valve 11' into the first combustion zone I. Butterfly valves 13' and 14' can be regulated to apportion the airflow between lines 13 and 14. The injection assembly 30 includes a tubular member 31 perpendicularly mounted with the closure member 24 about an opening **24*b* formed therein. The tubular member 31 forms an annular space 32** communicating with the first combustion zone.

As shown in FIG. 2, a fuel injection tube 33, interconnected at one end with the fuel supply line 10 (FIG. 1), is fixedly mounted within the annular space 32 and extends longitudinally therethrough on the longitudinal axis of the casing 26. The fuel injection tube 33 is preferably fixedly mounted to an end closure means 34 which is sealably connected with the annular tube 31 at its outer end flange **31*a*. The fuel injection tube 33 extends longitudinally through the annular space 32 into the combustion zone 28 and has one or more nozzles 33*a* of known construction for injecting the fuel into the combustion zone 28 as a fine spray or mist to provide thorough mixing of the fuel with air to facilitate essentially complete combustion thereof. Preferably, the fuel injection tube 33 extends into the portion of the combustion zone 28 formed by the annular surface 26*d* of the thickest refractory material layer first zone 26*a* such that the initial combustion occurs in the first zone. Further, a suitable valve control means (not shown) is provided to control the flow of fuel supplied through line 10 through the fuel injection tube 33 to permit initial fuel injection for ignition and subsequent fuel injection into the combustion zone 28** at a desired flow rate for normal operation.

An air inlet flange **13*a* (FIG. 3) is connected with the annular tube 31 to communicate with the annular space 32. The inlet 13*a* is connected with the first, or primary, air stream supply line 13 and thus permits the first, or primary, stream of pressurized air to be injected through the annular space 32 into the first combustion zone in a longitudinal direction circumferentially about the fuel injection tube 33 so as to provide thorough mixing of the first air stream and the fuel as the fuel is ejected from the nozzle 33*a***.

The combustion chamber C includes a second, or secondary, air stream injection means 50 strategically positioned for injecting the secondary air stream supplied from butterfly valve 14' through line 14, connected with flange **14*a*, and line 14*b* into the first combustion zone in a manner to cause some high turbulence fuel and air intermixing for facilitating substantially complete combustion of the hydrocarbon fuel. The three-way valve 11' can be regulated to vent the air from the air compressor to the atmosphere or to the first and second air injection means. The butterfly valves 13' and 14' can be adjusted to control airflow through lines 13 and 14. As illustrated in FIG. 2, the second or secondary air injection means 50 includes an annular member 51 positioned adjacent the portion 27 and end member 24 forming an annular air space 52 which communicates with the combustion zone 28 via a plurality of circumferentially spaced passages 53*a*, 53*b*, etc., which are preferably eight in number, extending through the lining portion 27 and the refractory material lining first portion 26*a* at an angle in the order of about 45° to the direction of flow through the zones. As shown, the second, or secondary, air stream is supplied to the air bussle 51 by means of the air inlet opening 54 through the end member 24 and which is connected with the tubing 14*b***.

The plurality of passages **53*a*, 53*b*, etc. are preferably cylindrical and substantially evenly spaced circumferentially relative to each other and extend from the air bussle 51 through the refractory material first zone at about 45° angles relative thereto and relative to the longitudinal axis of the cylindrical combustion chamber C so that respective longitudinal axes of the passages intersect at a point on the combustion chamber longitudinal axis a short distance downstream from the main fuel injection tube nozzle 33**.

It is believed that the air passages **53*a*, 53*b***, etc. should be oriented so that they direct the secondary air at or near the point of initial combustion. The burning or initial ignition of the fuel air mixture is believed to cause a swirling out effect with some unburned fuel at the exterior of the swirl. Accordingly, the secondary air would preferably be directly mixed with any such unburned fuel to further facilitate combustion. The above description of the results of the preferred orientation of the secondary air supply ports is not based on known scientifically accepted theory. Whatever may be the reasons behind the obtaining of the substantially complete combustion, it nevertheless occurs and it is not intended to limit the results and benefits obtained as based solely on the above description of operation or theory.

An electrical ignition assembly 35 (FIG. 3) is mounted with the closure member 24 and extends through the member 24 and the refractory material layer portion 27 into the first zone of the combustion chamber for providing ignition to the hydrocarbon fuel. The assembly includes a tubular member **35*a* having a cylindrical inner passage for insertion of a conventional sliding ram. The ignition assembly 35 is of conventional construction and the reciprocal longitudinally sliding ram has a conventional electrical spark-producing means positioned at one end which is connected to a conventional, suitable, electrical supply means. In operation, the ram is longitudinally moved through the passage in member 35*a* to position the spark means adjacent the fuel injection tube nozzle 33*a*. The hydrocarbon fuel and pressurized air streams are then supplied to the combustion zone 28 and an electrical spark is generated to ignite the fuel. After ignition, the longitudinal ram is pulled back into the passage for protection from the heat generated in the combustion zone 28. The tubular member 35***d* can be used for a sight glass using flange 35*e*. A suitable sight glass can be of conventional construction.

A water cooling jacket 40 is provided to further protect the pressure casing 20 from structural failure due to excessive heating. The water jacket 40 includes an outer casing 41 surrounding substantially the entire pressure casing 20 and a portion of the exhaust end and which is sealably mounted with the pressure casing 20 to form an annular space 43 (FIG. 2) through which a stream of cooling water is circulated for heat exchange with the casing 20. A plurality of spacer means or baffles 40*a*, 40*b*, and 40*c* are also included to position the outer member 41 in supporting relation about the pressure casing 20. The spacer means permits cooling water flow about the entire casing and exhaust outlet end. A cooling water inlet flange 45 (FIG. 1) is connected with the outer member 41, preferably adjacent the vapor generator end which is connected with line 15 to permit the stream of cooling water supplied by the water supply means W to be circulated through the space 43. Similarly, a water outlet flange 46 is provided, preferably adjacent the fuel injection end on an opposite side relative to the water inlet 45 through which the circulating cooling water is removed. The water outlet 46 is connected with line 16 which is in turn connected with the steam generating vessel V so that the cooling water circulated through the space 43 may be injected therein. The water circulated through the space 43 is heated through direct heat exchange with the pressure casing 20 and exhaust outlet end 22 and thus reduces the amount of heat required to be imparted to the water in the stream generating vessel V to produce steam. A drain flange means 47 is provided for draining the space 43.

Referring now back to FIG. 1, the steam generating or vapor generator, vessel V includes a substantially sealed drum or vessel 60 forming a thermal vapor producing chamber 61 for receiving the hot combustion gases produced in the pressure combustion chamber C. The drum 60 is provided with a nozzle means 63 for receiving water supplied thereto by the water supply means W through line 15, cooling jacket 40, and line 16 as described above. The water level is shown in FIG. 1 at 60*a*. Since the hot combustion gases entering the vessel vaporize the water therein forming steam, it is necessary to constantly replenish the water to maintain it at a desired level.

The steam generating vessel V further includes the hot combustion gas injection means I mounted within the drum 60 which includes a downwardly curved refractory lined cylindrical tube 64 interconnected with the combustion chamber exhaust outlet flange 22*a* by a flange 64*c* for injecting the hot combustion gases from the combustion chamber C into the water received in the drum 60. As illustrated, the injection tube 64 extends downwardly within the vessel chamber 61 through openings 65*a* and 66*a* formed in a pair of horizontally mounted perforated baffles 65 and 66 provided across the chamber 61 and has a cap means 64*a* sealing its lower end. A refractory lining 64*d* protects the injection tube 64 with the lining inside diameter being the same as refractory portion defined by surface 26*j*. The baffles facilitate distribution of the combustion gases in the water which increases vaporization. Also, the baffles act to retain the combustion gases in the water longer. The injection tube 64 has a plurality of openings 64*a* at its lower end positioned just below the upper baffle 65 through which the hot combustion gases are injected. The cross-sectional area of the openings 64*a* is at least as the cross-sectional area of the tube 64. The openings 64*a* are vertically spaced from the lower end 64*b* of the tube which lower end is blocked or plugged, so as to distribute the combustion gases through the openings 64*a* at different vertical locations in the vessel. The vessel and injection means is specifically designed so that the water level in the vessel can be varied so that some combustion gases are not injected through the water bath but rather are injected above the water level. This enables an operator to control the temperature of the combustion gas-steam mixture as well as the ratio of the combustion gases to steam existing the vessel. Another embodiment of the injection means is shown in FIG. 4 and includes only the elbow portion of the injection tube means I′ lined with refractory material 64*d*′ at the elbow portion. The elbow portion is subjected to the direct impingement of the hot gases and accordingly is protected by the refractory lining. The lower portion of the injection tube includes a plurality of openings 64*a*′ identical to the openings 64*a* in dimension and operation. An end closure means 64*b*′ blocks the end of the injection tube. Flange 64*c*′ is secured with flange 22*a* by suitable means, such as bolts (not shown).

The greater the water level above the uppermost openings in the tube 64, the more contact of the combustion gases and the water so that more steam is formed which takes heat from the combustion gases. Water is injected into the steam generating vessel V through one or more perforated nozzles 63. The nozzles 63 direct the water downward through multiple openings to create a large downward spray. This spray contacts the gases and generated steam and also provides some cooling of the elbow 64*c* which is subjected to intense heat. A suitable water level maintaining means (not shown) in the control room R may be provided to automatically maintain the water bath at the predetermined level in the vessel. Also, the water level can be manually set although an automatic means is preferable to maintain a minimum level in the vessel without requiring frequent monitoring during operation. The perforated baffles 65 and 66 cause the hot combustion gases to percolate through the water received in the chamber 61 to provide intimate gas-liquid contact for efficient formation of steam and mixing of the steam with the hot combustion gases.

A water blow-down outlet means 68 (FIG. 2) communicating with the vessel chamber 61 is also provided for removal of water and accumulated solids therefrom. Further, an inlet means 69 is provided for injecting chemicals into the water maintained in the vessel 61. Usually, suitable corrosion preventing chemicals are injected through the inlet means 69 to protect the vessel V and its component parts. Additionally, where desired, known chemical additives may be injected for admixture with the steam and combustion gases to improve injection into a subterranean formation and increase the recovery of liquefiable minerals therefrom. Such chemical additives are known to those having ordinary skill in the art and will not be specifically discussed herein. A safety relief valve 70 is provided to relieve pressure in the vessel should it become too high and unsafe. Analyzer inlet flange means 71 and 71*a* are provided for checking the flow stream exhausting from the vessel.

OPERATION

In the operation of the apparatus of the present invention, the high pressure air stream, produced by the high pressure air compressor A, is passed through line 11 to the air manifold 12 (FIG. 3) where it is split into a first air stream and a second air stream. The butterfly valves 13' and 14' are adjusted to apportion the air between the first and second air streams. The first air stream is supplied through conduit 13 to the combustion chamber injection assembly 30 (FIG. 2) and injected through the annular space 32 into the first combustion zone I of the combustion chamber C. The second air stream passes through line 14 (FIG. 3) to the annular air bussle 51 (FIG. 2) and is injected into the first combustion zone through the plurality of circumferentially spaced secondary air passages 53*a*, 53*b*, etc. as described above.

The stream of hydrocarbon fuel, supplied to the injection assembly 30 through line 10 by the fuel pump F, is then injected into the first combustion zone through the fuel injection tube 33 and ignited by operating the ignition assembly 35 in the manner described above.

Prior to fuel ignition, a flowing stream of water, supplied through line 15 (FIG. 1) by suitable pressure pumps of the water means W, is circulated through the annular space 43 (FIG. 2) of the cooling water jacket 40 and injected into the steam generating vessel chamber 61 via line 16 and water inlet 63 where it collects to a level between or above the baffles 65 and 66 provided therein. Preferably, the steam generating vessel V includes a spray nozzle means or the like communicating with the water inlet 63 so that the water is injected into the vessel chamber 61 in spray or droplet form to provide additional gas-liquid contact as the combustion gases pass through the openings 64*a* and out of the water bath in the vessel. The water supply in the vessel may be regulated by opening a valve (not shown) connected with the outlet 68 until sufficient vaporization occurs in the vessel at which time the valve is closed.

After fuel ignition, the injection rates and pressures of the pressurized air and fuel streams are regulated to provide substantially complete combustion of the hydrocarbon fuel and to produce the high pressure vapor stream at a desired pressure and flow rate. As previously mentioned, the apparatus is capable of operating under pressures of from about 300 to about 1,000 psig and provide substantially complete combustion of the hydrocarbon fuel. The apparatus is further capable of producing a high pressure thermal vapor stream having a pressure within this range and a temperature within the range of from about 200° F. to about 700° F. at a volume within the range of from about 200,000 to about 3 million SCFD.

Preferably, the high pressure air stream is supplied and injected into the combustion chamber C at a pressure within the range of about 450 to about 900 psig and at a rate up to about 3,000 SCFM. The hydrocarbon fuel is supplied and injected at a similar pressure and at a predetermined rate to provide the resulting vapor stream for injection, which preferably is within the range of from about 20 million to about 300 million BTU heat per day. The fuel injection rate is also dependent upon the type of hydrocarbon fuel employed. Numerous types of hydrocarbon fuel may be employed including, by way of example, fuel oil, natural gas, liquefied petroleum gas, gasoline, diesel fuel, crude oil, and the like with suitable modification of the injection nozzle as may be required. The particular fuel injection rate may be at least partially determined empirically.

Upon injection and ignition the fuel, primary air and secondary air streams are thoroughly intermixed in the initial combustion zone I. As previously mentioned, the positioning of the plurality of circumferentially spaced secondary air injection ports 53*a*, 53*b*, etc. is such that very high turbulence is obtained which facilitates substantially complete combustion of the fuel. The flowing stream of combustion gases produced, having a temperature of about 2,000° to about 4,000° F., passes from the combustion zone 28 through the exhaust outlet 22 and is injected through the injection tubes 64 or 64' into the water maintained in the drum 60 of the steam generating vessel V. The hot combustion gases percolate through the water which is vaporized to form steam. The steam and hot combustion gases intermix above the water level and are removed as the high pressure thermal vapor stream through outlet 67 and transported to the wellhead through line 17 and injected into the subterranean formation. The temperature of the pressurized thermal vapor stream thus produced may be regulated by adjusting the level of water in the vessel 60 which determines the amount of steam produced. The water level can be reduced to a level below the uppermost openings in the injection tube to increase the temperature of the thermal vapor stream by injecting a portion of the combustion gases directly above the water into the stream. Less steam is produced since less heat is given up by the combustion gases through vaporization. The vapor stream temperature is decreased and the steam content is increased by adding water at a faster rate to the vessel so as to raise the water level therein above the baffles. Increasing the temperature of the flow stream can be important since it is desirable to be able to control the temperature of the steam and hot gases. For example, under certain operating conditions it is desirable to run at superheated steam temperatures and at other times, it may be desired to control the temperature to heat equilibrium temperature. These temperatures are a function of the operating pressure and are known to those skilled in the art.

The apparatus of the invention is thus capable of continuously producing a high pressure thermal vapor stream having a temperature within the range of from about 200° F. to about 700° F., preferably about 375° F. to about 625° F., and a pressure within the above-mentioned operational pressure range at the above-mentioned flow rates and thus is capable of injecting from about 20 million to about 300 million BTU heat per day into a subterranean formation for recovering liquefiable minerals therefrom, particularly viscous petroleum.

The high pressure thermal vapor generating apparatus of the present invention is capable of being operated for extended lengths of time, as usually required in thermal injection techniques for recovering viscous petroleum, without experiencing structural breakdown caused by formation of hot spots in the transition zone portions of the combustion chamber. As mentioned above, the design of the refractory lined combustion zones along with the cooling jacket 40 overcomes this problem. Additionally, the combustion chamber C of the present invention is capable of continuously producing a stream of hot combustion gases free of relatively oxidizing components and soot over extended periods of time which is most desirable for known thermal injection techniques.

The foregoing disclosure and description of the invention are illustrative and explanatory thereof, and various changes in the size, shape, and materials as well as in the details of the illustrated construction may be made without departing from the spirit of the invention.

We claim:

1. An apparatus for producing a high pressure thermal vapor stream of steam and combustion products substantially free of oxidizing gases by burning a fuel in about stoichiometric amounts of air comprising:

casing means having plural, substantially cylindrical, refractory lined combustion zones of varying diameters forming a multiple zone combustion chamber extending along the longitudinal axis of the casing means;

said casing means having means sealing one end thereof and connecting means on an opposite end thereof for connection with a vapor producing vessel means;

a first zone of said plural refractory lined combustion zones having first a predetermined inner diameter for flowing gases therethrough;

first injection means for introducing predetermined volumes of air and fuel into said first zone and igniting the air and fuel therein;

second air injection means for injecting a second predetermined volume of air into said first zone adjacent said first injection means to cause turbulence and intermixing of the air and fuel in said first zone to facilitate complete combustion;

a second zone of the plural refractory lined combustion zones for receiving the flow of gases from said first zone and having a greater inner diameter than said first zone to provide maximum turbulence as the combustion products rapidly expand therein to provide substantially complete combustion of the mixture forming a hot gas stream substantially free of oxidizing gases;

a third zone of the plural, substantially cylindrical, refractory lined combustion zones for receiving the flow of gases from said first and second zones and having a greater inner diameter than said second zone for rapidly expanding the combustion gases to maintain maximum turbulence as the combustion products expand to facilitate complete combustion; and vapor producing vessel means for receiving the combustion gases to form a product stream of steam and combustion products through direct contact between the combustion gases and water.

2. The apparatus as set forth in claim 1, wherein:

said secondary air injection means includes a plurality of passageways extending through said first zone refractory lining at an acute angle to the direction of flow of gases through said zones and inwardly oriented in the direction of said second zone to cause turbulence and intermixing in said first zone.

3. The apparatus as set forth in claim 1, further including:

a final zone of the refractory lined combustion zones for receiving the flow of gases from said first, second and third zones and having a smaller inner diameter than said third zone for increasing the velocity of the combustion products to maintain turbulence and facilitate complete combustion.

4. The apparatus as set forth in claim 3, wherein:

said final zone has a smaller inner diameter than said first zone to increase the velocity and maintain turbulence to facilitate complete combustion.

5. The apparatus as set forth in claim 1, wherein:

the ratio of the inner diameter of said first zone to that of said second zone is in the range of from about 63% to about 78% to provide controlled expansion of the combustion gases to cause maximum turbulence of the gases flowing through the combustion zones.

6. The apparatus as set forth in claim 1, wherein:

the ratio of the inner diameter of said second zone to that of said third zone is in the range of from about 78% to about 93% to provide controlled expansion of the combustion gases to cause maximum turbulence of the gases passing through the combustion chamber.

7. The apparatus as set forth in claim 3, wherein:

the ratio of the inner diameter of said fourth zone to that of said third zone is in the range of from about 32.5% to about 47.5% to increase the velocity and turbulence of the combustion gases for substantially complete combustion.

8. The apparatus as set forth in claim 2, wherein:

said plurality of passageways are equally spaced circumferentially about said first zone.

9. The apparatus as set forth in claim 1, including:

said casing means having an outer cooling chamber means surrounding said casing means for receiving cooling water for protecting said casing means and said refractory lining thereof from overheating and for preheating the water for said vapor producing vessel means.

10. The apparatus as set forth in claim 1, including:

said first zone having a transition zone with a gradually increasing diameter from that of said first zone inner diameter to said second zone inner diameter to control expansion and avoid hot spots in said refractory lining.

11. The apparatus as set forth in claim 1, including:

said second zone having a transition zone with a gradually increasing diameter from that of said second zone inner diameter to said third zone inner diameter to control expansion and avoid hot spots in said refractory lining.

12. The apparatus as set forth in claim 1, including:

said first injection means having a cylindrical air passageway communicating with said first zone.

13. The apparatus as set forth in claim 12, including:

said first injection means having fuel injection means at a center portion of said first zone and surrounded by said cylindrical air passageway.

14. The apparatus as set forth in claim 1, including:

a final zone of said refractory lined combustion zones for receiving the flow of gases from said first and second zones and having a smaller inner diameter than said first zone for increasing the velocity of the combustion products to maintain turbulence and facilitate complete combustion.

15. A method of producing a high pressure thermal vapor stream of water vapor and combustion gases substantially free of oxidizing gases from burning a substantially stoichiometric ratio of fuel and air, comprising:

injecting a predetermined fuel and primary air ratio at a first location into a first refractory lined zone of a combustion chamber having a first diameter and igniting the fuel therein;

injecting a predetermined volume of secondary air mixture at a second location into the first zone to cause turbulence and mixing of the air and fuel in the first zone;

rapidly expanding the ignited gas mixture flowing from the first zone into a second refractory lined combustion zone having a larger diameter than the first zone to provide maximum turbulence as the mixture expands to facilitate substantially complete combustion of the mixture forming a hot gas stream substantially free of oxidizing gases;

further expanding the gas mixture into a third refractory lined combustion zone for receiving the flow of gases from said first and second zones and having a larger diameter than said second zone for rapidly expanding the combustion gases to maintain maximum turbulence as the combustion products expand to facilitate complete combustion; and flowing the hot gas stream from the third zone through a final refractory lined combustion zone into a vapor producing vessel to form a product stream of water vapor and combustion gases through direct contact between the combustion gases and water.

16. The method as set forth in claim 15, including the step of:

rapidly expanding the predetermined air-fuel mixture flowing from the second zone into a third refractory lined combustion zone having a larger diameter than the second zone before flowing to the final zone to provide maximum turbulence to facilitate complete combustion.

17. The method as set forth in claim 15, wherein:

the step of injecting the secondary air includes directing the secondary air substantially adjacent the point of initial combustion in the first zone to mix with unburned fuel to facilitate complete combustion.

18. The method as set forth in claim 16, including the step of:

flowing the gases from the third zone into the combustion zone having a reduced diameter to increase the velocity of the combustion gases after the second expansion thereof to maintain turbulence for facilitating complete combustion and for exhaust from the combustion chamber.

19. The method as set forth in claim 15, wherein:

the step of expanding includes expanding the gas mixture in a transition zone portion of the first zone having a gradually increasing diameter to the second zone to avoid causing hot spots in the combustion chamber during expansion.

20. The method as set forth in claim 15, including the step of:

supplying cooling water under pressure about the periphery of the combustion chamber to cool the chamber and to preheat the water for the vapor producing vessel.

21. The method as set forth in claim 17, wherein:

said step of injecting the secondary air includes injecting the secondary air circumferentially about the first location to cause turbulence and to thoroughly mix the fuel and air for facilitating substantially complete combustion.

22. The method as set forth in claim 18, wherein:

said step of flowing the gases into the final zone includes increasing the velocity of the gases by flowing gases in the final zone having a diameter less than the first zone.

* * * * *